United States Patent [19]

Madjeski

[11] Patent Number: 5,042,772

[45] Date of Patent: Aug. 27, 1991

[54] MIRROR ALIGNING DEVICE

[76] Inventor: Terry M. Madjeski, 770 McCourry, Incline Village, Nev. 89450

[21] Appl. No.: 505,576

[22] Filed: Apr. 6, 1990

[51] Int. Cl.[5] ..... A47F 1/14

[52] U.S. Cl. ..... 248/467; 269/1; 269/21; 269/43

[58] Field of Search ..... 248/467, 206.2, 206.3; 269/1, 21, 43

[56] References Cited

U.S. PATENT DOCUMENTS

| | | | |
|---|---|---|---|
| 1,468,197 | 9/1923 | Downing | 269/21 |
| 1,849,338 | 3/1932 | Stansberry | 248/206.3 |
| 2,047,658 | 7/1936 | Zaiger | 269/21 |
| 2,990,305 | 6/1961 | Richardson | 269/21 X |
| 3,305,202 | 2/1967 | Christenson | 248/467 |
| 3,630,511 | 12/1971 | Evans | 269/43 |
| 3,661,683 | 5/1972 | Engel et al. | 269/21 X |
| 3,770,259 | 11/1973 | Wagreich | 269/21 |
| 3,964,710 | 6/1976 | Conroy | 269/21 |
| 4,291,866 | 9/1981 | Petersen | 269/1 |
| 4,497,476 | 2/1985 | Wiele | 269/1 |
| 4,828,303 | 5/1989 | Soria . | |

FOREIGN PATENT DOCUMENTS

| | | | |
|---|---|---|---|
| 310936 | 4/1989 | European Pat. Off. | 269/21 |

*Primary Examiner*—Gary L. Smith
*Assistant Examiner*—Michael J. Milano

[57] ABSTRACT

A device for aligning the surfaces of two abutting mirrors while the mirrors are being adhesively secured to a room wall. The aligned mirrors will reflect in the same direction so as to avoid disruptions or discontinuities in the total reflected picture. An alignment bar having suction cups therealong is used to align and hold the mirrors in fixed positions while the adhesive on the mirror rear surfaces is curing to a solid rigid condition.

3 Claims, 1 Drawing Sheet

MIRROR ALIGNING DEVICE

BACKGROUND AND SUMMARY OF THE INVENTION

This invention relates to wall-mounted mirrors, and particularly to seamed mirrors, i.e. mirrors formed by two or more rectangular mirrors arranged in side-by-side relation on a room wall surface. In some cases such seamed mirrors can occupy an entire room wall from the floor to the ceiling. A room wall eighteen feet long might require six mirrors (assuming each mirror has a width of three feet).

The mirrors in a seamed mirror assembly should desirably have their front faces in a common plane in order to avoid distortion or disruption in the reflected images. However, this is not always easily attainable, due e.g. to irregularities in the room wall surface and or slight variations in mirror thickness.

Very often mirrors are secured to a room wall surface with a relatively thick coating of mastic (paste cement) between the rear face of each mirror and the room wall surface. The mastic is a paste material that can deform or flow when pressure is applied to the front (exposed) face of each mirror. By applying manual pressure to selected mirrors and/or exerting a pulling force on selected mirrors it is possible to shift the mirrors slightly toward the wall surface or away from the wall surface while the mastic is in the plastic (paste) state. In this way it is possible to reposition the mirrors so that the abutting edges of the mirrors are in approximately a common plane. However the pushing-pulling process is not easily accomplished due to the fact that it is difficult to effectively grasp a mirror to exert a pulling force thereon. Also, tension forces in the mastic may tend to cause an out-of-line mirror to return to its initial position after it has been shifted to an in-line condition.

The present invention concerns a device that can be used on two (or more) mirrors to shift them into a common plane while the mastic is setting (i.e. curing). The device can be manipulated to exert a pushing or pulling force on one or more of the mirrors, to thereby bring the mirrors into alignment. While the mastic is setting the pushing-pulling device remains attached to the mirrors so that they remain aligned. The device is removed from the mirrors when the mastic is in its cured (solid) state.

THE DRAWINGS

DESCRIPTION OF A PREFERRED EMBODIMENT OF THE INVENTION

Figure 1:
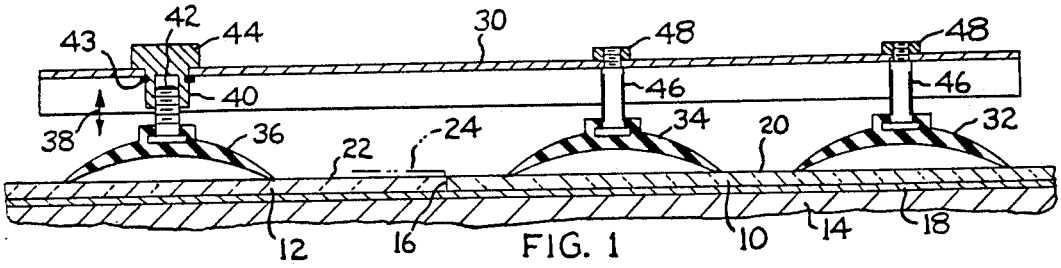
FIG. 1 is a sectional view through a device of the present invention. The device is shown in an attached position on two conventional mirrors.

FIG. 1 shows two mirrors 10 and 12 arranged in side-by side relation on a room wall 14. Edge areas of the mirrors abut together to define a crack-like joint 16. The mirrors are held on wall 14 by a layer of adhesive (mastic) 18. As shown in the drawing, the exposed faces

20 and 22 of the two mirrors are in a common plane. FIG. 1 represents the ideal condition wherein the two mirrors function essentially as one single continuous mirror (except for the minor interruption provided by joint 16).

Dashed line 24 in FIG. 1 illustrates an undesired condition of mirror 12, wherein its exposed face is raised slightly above the plane of the exposed face of mirror 10. With such a condition mirror 12 will reflect in a slightly different direction than mirror 10, such that there will be a blank spot in the total reflected picture.

The condition depicted by dashed line 24 can occur for a number of reasons, e.g. irregularities in the room wall surface, or mirror thickness variations, or variations in the thickness of the mastic. The present invention provides a device for minimizing variations in the frontal surface planes of the two mirrors. As shown in FIG. 1, the device comprises an elongated bar 30 that is adapted to extend in front of the two mirrors so as to span joint 16. Two suction cups 32 and 34 are mounted on bar 30 near its right end. A third suction cup 36 is mounted on the bar near its left end. The bar can have a channel cross section so that it has longitudinal rigidity; the bar does not bend.

Suction cup 36 is adjustably mounted (attached) on bar 30 so that the suction cup can move toward or away from the bar, as indicated generally by numeral 38. The adjustable mounting structure comprises an internally threaded nut 40 swivably mounted on bar 30, and an externally threaded shaft (screw) 42 extending from suction cup 36 into nut 40. A manual knob 44 is connected to nut 40, such that manual rotation of the knob causes suction cup 36 to move toward or away from bar 30. An E-ring 43 may be carried on nut 40 to prevent axial dislocation of the nut.

Suction cups 32 and 34 can be fixedly attached to bar 30 by any suitable means. The attachement means shown in FIG. 1 comprises a threaded shaft 46 extending from the suction cup through an opening in bar 30, and a nut 48 carried on the free end of the shaft.

The device shown in FIG. 1 is applied to mirrors 10 and 12 after the mirrors are in place on the room wall surface. Prior to curing of the mastic coating 18 the mirrors are in floating conditions wherein they can be moved toward or away from the surface of the room wall 14, as necessary for proper alignment of the mirror exposed faces. The FIG. 1 device is moved to span the two mirrors so that suction cups 32 and 34 are in gripping engagement with mirror 10.

If the surface of mirror 12 is initially raised above the surface of mirror 10 at joint 16, knob 44 will be manually rotated to move suction cup 36 away from bar 30, thereby causing the suction cup to exert a push force on mirror 12. If the surface of mirror 12 is depressed below the surface of mirror 10 at joint 16, knob 44 will be rotated to move suction cup 36 toward bar 30, thereby causing the suction cup to exert a pulling force on mirror 12. The suction condition within cup 36 keeps the cup in operative engagement with the mirror surface. The pulling or pushing action can be used to bring mirrors 10 and 12 into planar alignment, as shown in full lines in FIG. 1.

It should be noted that there are two suction cups engaged with mirror 10 and only one suction cup engaged with mirror 12. When knob 44 is rotated, bar 30 will tend to remain in a fixed position relative to mirror 10 because the two suction cups 32 and 34 provide a stable two-point support for the right end of the bar. Assuming a rigid positonment of bar 30 relative to mirror 10, then the net effect of knob 44 rotation is to pull or push mirror 12 into planar alignment with mirror 10, as shown in FIG. 1 (full lines).

When the surfaces of mirrors 10 and 12 are in planar alignment at joint 16 the adjusting operation is complete. However the device is not immediately removed from the mirrors. Instead the device is left in place on the mirrors so as to act as a tying connection between the two mirrors during the mastic curing (setting) process. When the mastic is in a solid (cured) condition the device is removed from the mirrors.

Very often the mirrors are relatively long in direction parallel to edge joint 16. For example each mirror can have a width dimension (in the plane of FIG. 1) of three feet, and a length dimension (parallel to joint 16) of six feet. In such case two devices will be used to align the abutting mirrors. The devices can be positioned about two feet in from the respective side edges of the mirrors, as shown generally in diagrammatic FIG. 4.

Figure 4:
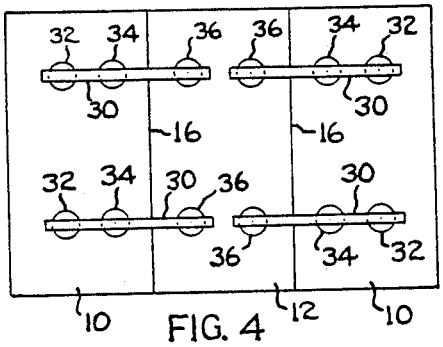
FIG. 4 is a diagrammatic illustration of multiple alignment devices arranged on three mirrors.

FIG. 4 shows a three-mirror system that includes a central mirror 12 and two end mirrors 10, 10. A pair of alignment devices is used to align the left surface area of mirror 12 with the left mirror 10; a second pair of alignment devices is used to align the central mirror with the rightmost mirror. The alignment devices are left in place on the mirrors while the mastic is undergoing the curing process.

Figure 2:
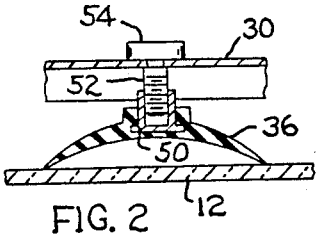
FIG. 2 is a fragmentary sectional view of a suction cup adjustment structure that can be used in the FIG. 1 mechanism.

FIG. 1 shows the two suction cups 32 and 34 as being fixedly attached to bar 30. However, one or both of these suction cups can be adjustably attached to bar 30 in the same fashion as suction cup 36. Also, the adjusting mechanism can be varied as regards its structural configuration. As shown in FIG. 2, the adjusting mechanism comprises an internally threaded nut 50 embedded in the suction cup, and a threaded shaft 52 having a swivel fit on bar 30; a manual adjustment knob 54 is secured to the end of shaft 52. FIG. 2 is essentially a reversal of parts of the construction shown in FIG. 1.

Figure 3:
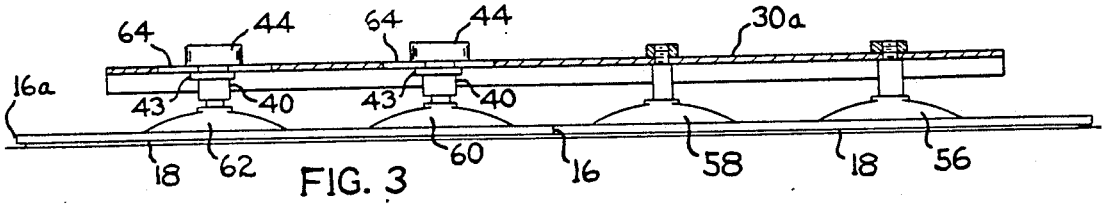
FIG. 3 is a sectional view through another mechanism embodying the invention according to the teachings of the invention.

FIG. 3 shows an embodiment of the invention wherein four suction cups are utilized. The two rightmost suction cups 56 and 58 are fixedly attached to bar 30*a*; the two leftmost suction cups 60 and 62 are adjustably attached to bar 30*a*. The adjustment mechanism for suction cups 60 and 62 may be similar to the adjustment mechanism shown in FIG. 1.

The FIG. 3 device is in some respects more advantageous than the FIG. 1 device in that it can be used to adjust mirror 12 along both of its side edges 16 and 16*a*, thereby ensuring a more precise planar alignment of the two mirrors. Initially suction cup 60 can be adjusted to bring the mirror edges at joint 16 into planar alignment. Even though the mirror surfaces at joint 16 are in planar alignment, the two mirrors can be out of alignment at their other edges 16*a*. However, by placing a straight edge on the two mirror surfaces and adjusting suction cup 62 it is possible to raise (or lower) the mirror 12 surface at edge 16*a* so as to achieve an aligned condition. FIG. 3 shows one alignment device spanning the two mirrors. It should be realized however that in practice two such devices will be utilized, as shown diagrammatically in FIG. 4.

The drawings show arrangements wherein the alignment bar (30 or 30*a*) is long enough to span two abutting mirrors. However, the bar could be elongated to span three or more mirrors (depending on the number of mirrors in the mirror assembly). At least one suction cup would be assigned to each mirror. All of the suction cups could be adjustably attached to the alignment bar, such that a pushing force or a pulling force could be applied to each mirror as necessary to achieve planar alignment of all mirrors in the mirror system.

In some situations the alignment process may be facilitated by moving one or more of the suction cups along the alignment bar, e.g. closer to the mirror joint 16 or further away from the adjacent suction cup. FIG. 3 shows two slots 64 in bar 30*a* for accommodating sliding movements of suction cups 60 and 62 along the bar. Each slot is slightly wider than the diameter of nut 40 but narrower than the diameter of the associated E-ring 43, such that the suction cup is prevented from axial dislocation from bar 30*a*.

The drawings necessarily show specific forms that the invention can take. However it will be appreciated that the invention can be practiced in other forms and configurations.

I claim:

1. A device for shifting a first mirror relative to a second mirror so that the front surfaces of the two mirrors are in a common plane after the two mirrors have been adhesively secured to a room wall surface; said device comprising an elongated rigid bar adapted to simultaneously extend across two abutting mirrors, to thereby span the joint defined by the abutting mirror edges; first and second suction cups mounted on said bar for gripping engagement with one of the mirrors; a third suction cup adjustably mounted on said bar for gripping engagement with the other mirror; a screw type manual adjustment means extending from said third suction cup through the bar for moving said third suction cup toward or away from the bar, whereby said third suction cup is enabled to exert a pulling force or a pushing force on said other mirror; and means (64) for sliding said third suction cup and the associated adjustment means longitudinally along said bar so that said third suction cup can take different adjusted positions relative to the joint defined by the abutting mirror edges.

2. The device of claim 1, wherein said sliding means comprises a longitudinal slot in the bar.

3. The device of claim 1, and further comprising a fourth suction cup mounted on said bar for gripping engagement with said other mirror, and a second screw type manual adjustment extending from said fourth suction cup through the bar for moving said fourth suction cup toward or away from the bar, whereby said fourth suction cup is enabled to exert a pulling force or a pushing force on said other mirror.

* * * * *